US007607664B1

(12) United States Patent
Ward

(10) Patent No.: US 7,607,664 B1
(45) Date of Patent: Oct. 27, 2009

(54) MARRIAGE AND DIVORCE GAME

(76) Inventor: James F. Ward, 802 Pine Tree Dr., New Bern, NC (US) 28562

( * ) Notice: Subject to any disclaimer, the term of this patent is extended or adjusted under 35 U.S.C. 154(b) by 0 days.

(21) Appl. No.: 12/026,116

(22) Filed: Feb. 5, 2008

(51) Int. Cl.
*A63F 3/00* (2006.01)

(52) U.S. Cl. ..... 273/243; 273/285

(58) Field of Classification Search ..... 273/243, 273/244, 248, 285
See application file for complete search history.

(56) References Cited

U.S. PATENT DOCUMENTS 5,183,258 A * 2/1993 Lerke ..... 273/252
5,207,792 A * 5/1993 Anderson ..... 273/256
5,896,263 A * 4/1999 Terdan et al. ..... 361/101
6,203,017 B1 * 3/2001 Schultz ..... 273/285

* cited by examiner

*Primary Examiner*—Vishu K. Mendiratta
(74) *Attorney, Agent, or Firm*—Coats & Bennett, P.L.L.C.

(57) ABSTRACT

A marriage and divorce game and game board. The game board is divided into four quadrants and includes a plurality of defined spaces that extend around the periphery of the game board. A church and a courthouse are disposed in a central area of the game board. There is provided an array of consequence cards that include marriage, divorce, pastor and judge cards. The marriage and divorce cards include events that relate to marriage or divorce. The pastor and judge cards also include events such as penalties and benefits. Through the course of the game, points are accumulated by the individual players and individual players whose tokens land on spaces corresponding to the marriage, divorce, pastor and judge cards are required to draw an appropriate card from a deck and deal with the consequences of the card or gain the benefit conferred by the card.

6 Claims, 4 Drawing Sheets

1 START _____ 10 POINTS
2 BICYCLE _____ 1 POINT
3 DAY CARE _____ 2 POINTS
4 SCHOOL _____ 3 POINTS
5 ABC'S _____ 4 POINTS
6 YOU CHOOSE M OR D ____
7 JUDGE'S CHAMBER _____
8 HOMEWORK _____ 1 POINT
9 PRINCIPAL'S OFFICE _____ 2 POINTS
10 HOUSE PARTY _____ 3 POINTS
11 GO TO COLLEGE _____ 4 POINTS
12 YOU CHOOSE M OR D ____
13 PROM _____ -2 POINTS
14 ROTC _____ 1 POINT
15 DATING GAME _____ 2 POINTS
16 RESTAURANTS _____ 3 POINTS
17 MOVIES _____ 4 POINTS
18 YOU CHOOSE M OR D ____
19 GO TO JUDGE'S CHAMBERS _
20 RENT AN APARTMENT _____ 1 POINT
21 HONEYMOON _____ 2 POINTS
22 NURSERY _____ 3 POINTS
23 BUY A HOUSE _____ 4 POINTS
24 YOU CHOOSE M OR D ____
25 WEDDING _____ -3 POINTS
26 DOCTOR _____ 1 POINT
27 MOW LAWN _____ 2 POINTS
28 BUY A CAR _____ 3 POINTS
29 PARTY TIME _____ 4 POINTS
30 YOU CHOOSE M OR D ____
31 PASTOR'S CHAMBER _____
32 GO FISHING _____ 1 POINT
33 SAILING _____ 2 POINTS
34 TRAVEL _____ 3 POINTS
35 PLAY GOLF _____ 4 POINTS
36 YOU CHOOSE M OR D ____
37 RETIREMENT AGE 62 _____
38 WATCH TV _____ 1 POINT
39 SECOND CAREER _____ 2 POINTS
40 AFTERNOON NAP _____ 3 POINTS
41 BABY SITTING _____ 4 POINTS
42 YOU CHOOSE M OR D ____
43 GO TO PASTOR'S CHAMBER _
44 ROCKING IN THE CRADLE ___ 1 POINT
45 NURSERY RHYMES _____ 2 POINTS
46 CRAWLING _____ 3 POINTS
47 FIRST BOOKS _____ 4 POINTS
48 YOU CHOOSE M OR D ____
D DIVORCE CARDS _____
M MARRIAGE CARDS _____

*FIG. 1B*

MARRIAGE AND DIVORCE GAME

BACKGROUND

Marriage is a splendid institution and couples enjoy many exciting and cheerful moments leading to marriage. Events and occurrences that lead to divorce, on the other hand, often result in other types of experiences, often not as enjoyable as those leading to marriage. However, in some cases, even events leading to divorce are pleasant and enjoyable when the parties divorcing are in agreement and looking forward to what life has to offer after divorce.

Marriage is certainly a reality in the lives of most people. In many cases, divorce is also a reality. Because of these realities, marriage and divorce plays an important role in the lives of people and in the lives of their families. The present game and game board is designed to allow people of all ages to play a game whose focus is on the institution of marriage as well as the realities of divorce, and how events and circumstances impact marriage and divorce.

SUMMARY

The present invention relates to a game and a game board that focuses on marriage and divorce. Throughout the course of playing the game, players will, in a fun and enjoyable manner, be exposed to common occurrences experienced by people planning or wishing to be married, as well as events and circumstances that might be experienced by those planning or wishing to be divorced.

BRIEF DESCRIPTION OF THE DRAWINGS

FIG. 1B is a keyed summary of the content of the various spaces of the game board shown in FIG. 1A.

DETAILED DESCRIPTION

The present invention entails a game and a game board that focuses on marriage and divorce. Each player begins with one basic stated goal—to be married or divorced. At the beginning of the game, each player declares whether his or her object is to be married or divorced. Eventually a game winner is declared and that winner is deemed to have reached his or her goal of being married or divorced, depending on the initial election. Before discussing the game, its rules and how the game is played, it is beneficial to review the game board and the various pieces and paraphernalia that accompany the game board.

Figure 1A:
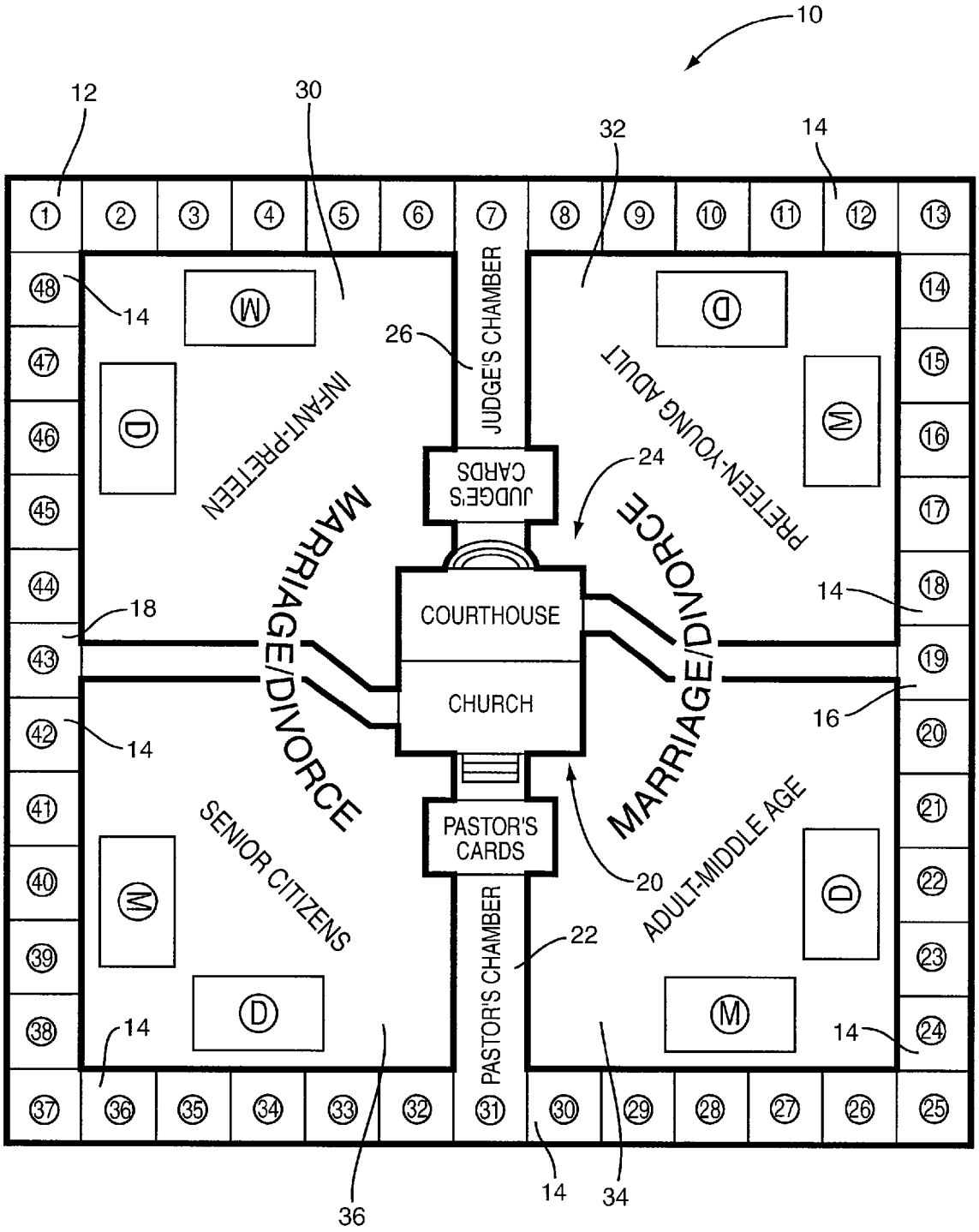
FIG. 1A is a top plan view of the game board of the present invention.
Figure 2:
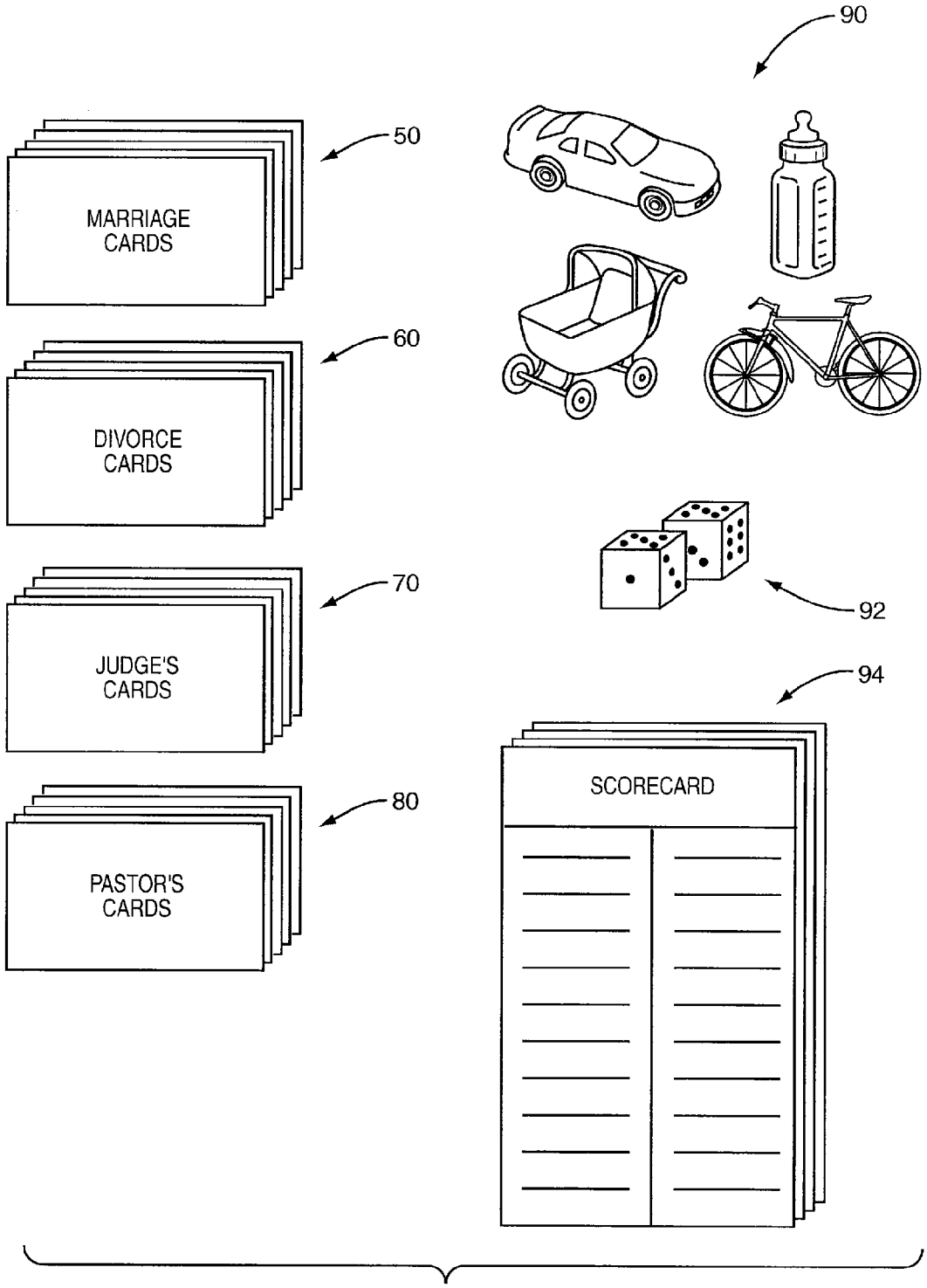
FIG. 2 illustrates components of the game structure in addition to the game board.
Figure 3A:
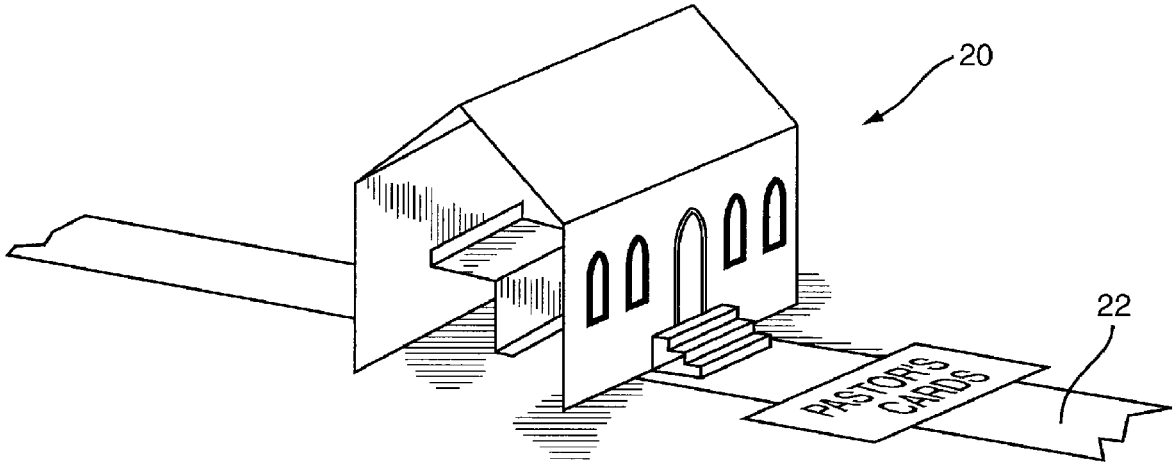
FIG. 3A is a fragmentary perspective view of a portion of the game board showing the pop-up church in the popped-up position.
Figure 3B:
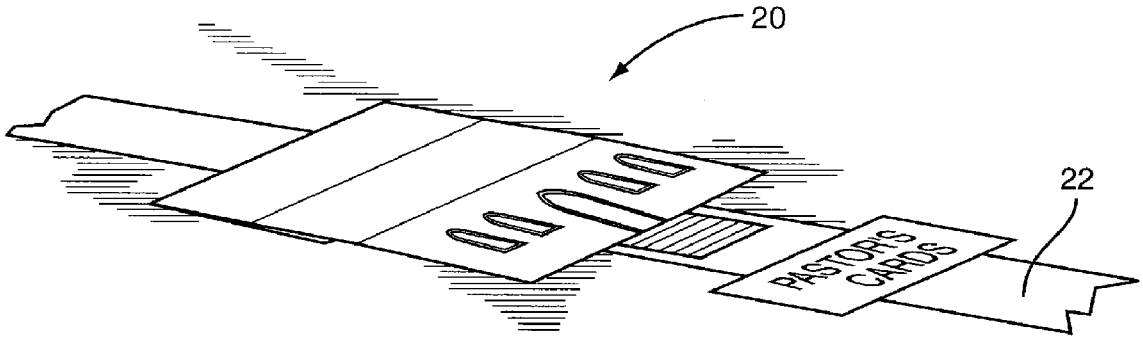
FIG. 3B is a view similar to FIG. 3A, but with the pop-up church shown in a generally flat configuration.

With further reference to the drawings, a game board is shown therein and indicated generally by the numeral 10. Game board 10 can assume a rectangular, square or other shaped configuration and can be constructed of various suitable materials such as cardboard, plastic, etc. As seen in the drawings, the game board includes a series of side by side defined spaces that extend around the periphery of the game board 10. Because of space limitations in FIG. 1, the contents of each space cannot be fully shown therein. However, FIG. 1B provides a full explanation of the content of each space provided around the game board 10. A key number is shown on each space in FIG. 1, and the same key numbers appear in FIG. 2 along with a full explanation of the content of each space. In the case of the embodiment illustrated in the drawings, the game board is generally square and the defined spaces extend one beside the other around the perimeter of the board.

The defined spaces serve various functions and come into play in different ways during the course of a game. One of the defined spaces is a start space designated by the numeral 12. Start space 12 is formed, in this embodiment, in the corner of the game board 10. There are many other defined spaces that extend around the board and many of these spaces have associated therewith points. Viewing the game board at the start space 12, and viewing clockwise from the start space, it is seen that some examples of the spaces are: "Bicycle—1 Point," "Daycare—2 Points," "School—3 Points," "ABCs—4 Points," "Homework—1 Point," "Principal's Office—2 Points," "House Party—3 Points," "Go to College—4 Points," etc. These particular spaces are defined as point spaces because they have one or more points associated with each. As noted above, FIG. 1B describes the content of the various spaces surrounding the game board 10.

In addition to the point spaces just described, there are a series of marriage or divorce spaces indicated by the numeral 14. In the embodiment illustrated herein, the marriage and divorce space is integrated, meaning that each of these spaces 14 is both a marriage or a divorce space. It is appreciated that the marriage and divorce spaces could be divided such that there would simply be one or more spaces designated marriage and one or more spaces designated divorce. As will be appreciated from subsequent portions of this disclosure, during the course of playing the game, if a player lands on a marriage or divorce space 14, the player will then draw a marriage or divorce card, depending on the player's initial declaration, and each of the marriage or divorce cards will have a consequence or result that will impact the player or require the player to take some action or accept some benefit or detriment.

There are also one or more judge spaces 16. As will be appreciated from subsequent portions of this disclosure, from time to time a player may land on a judge space 16 and as will be described, will be required to draw a judge card. Likewise, there is provided one or more pastor spaces 18 around the periphery of the game board 10. In like manner, landing on a pastor space 18 will require the player to draw a pastor card.

Disposed generally in the central area of the game board 10 is a church indicated generally by the numeral 20. The church 20 can assume various shapes, configurations and can be presented in various ways. In one embodiment, the church 20 is a popup church. That is, the church 20 can assume two different configurations on the game board 10. In one configuration, the church 20 folds down to a compact and flat configuration. This is especially useful when the game board is folded in half about a seam provided through or along the game board. In addition, the popup church can be moved to a popup position where it extends upwardly from the game board and assumes a three-dimensional configuration.

There is also provided a pastor's chamber area 22 on the game board 10. Note in the case of the embodiment illustrated herein, the pastor's chamber area 22 extends from an edge of the game board 10 inwardly to the church 20.

Similar to the church 20, the game board 10 includes a courthouse indicated generally by the numeral 24. The courthouse can assume various shapes and configurations and can be presented in various ways. As with the church 20, the courthouse 24 in the embodiment illustrated herein is a popup courthouse. That is, the courthouse 24 folds and generally assumes a flat configuration adjacent the surface of the game board 10. However, when the game board is opened and during play, the courthouse 24 pops up and extends upwardly from the surface of the game board 10 and assumes a generally three-dimensional configuration.

Game board 10 also includes a judge's chamber area 26. The judge's chamber area 26 extends from one edge of the game board 10 inwardly to the courthouse 24. In the embodiment illustrated herein, the church 20 and courthouse 24 are disposed in back to back relationship to each other and the respective chamber areas 22 and 26 extend outwardly from the church 20 and the courthouse 24 to the extreme outer edge of the game board 10.

Game board 10 is divided into a series of quadrants where each quadrant plays a role in the course of the game. In the case of the embodiment illustrated herein, game board 10 is divided into four quadrants. Names are given to each of the four quadrants but it is understood that these names may change and vary. In the embodiment illustrated herein, there is a first quadrant that is denoted "Infant-Preteen" and this quadrant is indicated generally by the numeral 30. A second quadrant is denoted "Preteen-Young Adult" and is denoted by the numeral 32. A third quadrant is referred to as "Middle Age" and is referred to by the numeral 34. A fourth quadrant is referred to as "Senior Citizens" and referred to by the numeral 36.

The game and game apparatus is provided with a series of various consequence cards. These consequence cards can vary in number and type. In the embodiment illustrated herein, there is an array of cards referred to as "marriage cards" and indicated generally by the numeral 50. Further, there is provided an array of "divorce cards" and these cards are referred to generally by the numeral 60. Additionally, there is provided an array of "judge cards" and these are referred to generally by the numeral 70. Finally, there is provided an array of "pastor cards" and these are referred to generally by the numeral 80.

The marriage and divorce cards are divided into a plurality of sets. In the embodiment illustrated herein, the marriage cards 50 are divided into four sets of marriage cards and the divorce cards 60 are divided into four sets of divorce cards. Here, the number of sets of marriage and divorce cards 50 and 60 corresponds to the number of quadrants of the game board. Each set of marriage cards is color coded such that one set can be distinguished from the others. The same holds true for the divorce cards 60. Each set of the divorce cards are color coded such that one set of divorce cards can be distinguished from the other sets. The game board includes marriage card receiving areas. That is, in each quadrant 30, 32, 34, and 36 of the game board 10 there is an area designated "Marriage Cards." A set of marriage cards is stacked in each quadrant of the game board 10. It should be pointed out that the marriage cards 50 and the divorce cards 60 are designed or tailored to fit the category of the respective quadrants 30, 32, 34, and 36. For example, the events provided on the marriage cards 50 that are stacked in the Adult-Middle Age quadrant 34, are at least to some degree appropriate for adult and middle aged people. The same holds true for the divorce card 60 and the respective quadrants that they are placed in on the game board. A better appreciation for this concept can be gained from studying the various exemplary events found on the various marriage cards 50 and various divorce cards 60 discussed below. Each marriage or divorce card (or any card of the game) can be constructed of various suitable materials such as plastic, paper, cardboard, etc. Included on each marriage card is what is referred to as a marriage event. For example, in the set of marriage cards for Senior Citizens, an example of an event is "Grandma has lots of love." In any event, the terms "marriage event" as used herein means a message carried on a card that relates to an occurrence or event that might impact a marriage or plans for a marriage. In addition, each marriage card has one or more points associated therewith. The points can be plus or minus points and will vary over a selected range.

Likewise, the divorce cards 60 will each include a divorce event. For example, a divorce event set forth on one divorce card in one embodiment is "Everything is your way." The term "divorce event" as used herein means a message carried on a card that relates to an occurrence or event that might impact a marriage. Like the marriage cards 50, the divorce cards 60 include points, some points being positive and some being negative. The points vary over a selected range.

Marriage events and divorce events may vary. In the case of the embodiment illustrated herein, as noted above, four different sets of marriage cards are provided and four different sets of divorce cards are provided. Examples of various marriage or divorce events for each set of cards are as follows:

Examples of Marriage Cards for Infant-Preteen Set

| Marriage Event | Points |
|---|---|
| New Baby on the way. | +7 |
| Take the kids for a stroll. | +2 |
| It's your turn to change his diaper. | +2 |
| Careful with the hose you might get wet. | −2 |
| Girls night out. | −5 |
| Boys night out. | −5 |
| It's time to feed the baby. | +2 |
| Sam. Wake-up feed time. | +2 |
| Walk the baby to stop crying. | +2 |
| Read to the kids 3 books a day. | +2 |
| Take the kids to the park. | +2 |
| Go ice skating. | +7 |
| Go fishing with kids. | +2 |
| It is time to go sailing. | +7 |
| The wife has PPD time for a divorce. | −10 |
| No help from husband time for a divorce. | −10 |
| She is a handy person in all things. | +5 |
| No house cleaning for me. | −2 |
| Its time to mow the lawn. | +4 |
| You have to cook tonight. | +2 |
| Night out on the town. | −5 |
| Children demand all your attention. | +2 |
| No time for me - HELP. | −5 |
| Bring me the baby and then cook supper. | +2 |
| Who said raising kids was work. | +2 |
| Honey put the kids to bed for me. | +2 |
| Clean house tonight I have to work Saturday. | −4 |
| If only I could get a break. | −4 |
| I'm home free summer vacation. | +2 |
| I worked all day, baby not fed, you sleep on couch, house is dirty. | −10 |
| Lack of understanding creates anger makeup (pastor). | −2 |
| First car lets go for a ride. | +2 |
| Big diamonds buy the wrong kind of love. | −2 |
| To friends forever. | +5 |
| Today's our first date. | +2 |
| I waited a long time for a kiss. | +2 |
| Lets go to church. | +5 |
| You're grounded. | −5 |
| Last chance to get it right. | −5 |
| I'm glad to be home. Save this card. Its the game winner if only two people are left in the game. | +2 |

Examples of Marriage Cards for Preteen-Young Adult

| Marriage Event | Points |
|---|---|
| You get braces. | +7 |
| Be little people. | −2 |
| Swears at partner. | −2 |
| Tells lies constantiy. | −5 |
| Gives dirty looks. | −5 |
| We need to talk. | +7 |
| Kicks dog when mad. | −2 |
| Smells like a skunk. | +2 |
| Throws dishes at partner. | −2 |
| Takes keys to the car. | −2 |
| You are more attracted to the lifeguard. | −2 |
| Two straps on shoulder are used for what? | −5 |
| Won't dance with me. | −2 |
| Drinks to much. | −2 |
| Does drugs partner does not know. | −2 |
| Party's every day. | −2 |
| No respect for partner. | −2 |
| Loves to play spin the bottle. | +7 |
| Partner makes your day. | +5 |
| Partner to lame to marry. | −5 |
| You throw up on date. | −2 |
| Totally selfish person. | −2 |
| I'm so hot I can't marry. | +2 |
| I'm an adult that doesn't need a job. | −4 |
| First kiss. | +2 |
| Goes to mall with friends. | +2 |
| Promotes self esteem. | +7 |
| Jealous partner. | −2 |
| Never lies to partner. | +2 |
| Gives partner complete attention. | +4 |
| Helps with dishes. | +2 |
| Your best friend likes same girl. | −2 |
| Sex is every thing. | −5 |
| Does not do drugs. | +2 |
| Has a great since of humor. | +2 |
| Does not abuse relationship. | +4 |
| Skinny dipping for first time. | −5 |
| You sneak over to his or her house. | −2 |
| You broke window by accident throwing rock. | +2 |
| Be happy. You are game winner if you hold this card and only two people are left in the game. | +5 |
| You kiss in front of friends. | +2 |

Examples of Marriage Cards for Adult-Middle Age

| Marriage Event | Points |
|---|---|
| Never takes wife and kids. | −5 |
| Always takes wife and kids | +5 |
| Has sugar daddy on the side. | −5 |
| Has sugar momma on the side. | −5 |
| Every thing is your way. | −5 |
| Gossip got the best of her. | −5 |
| Discontent follows him every where. | −5 |
| He is physically abusive. | −5 |
| She is mentally abusive. | −5 |
| You areas crazy as a bed bug. | −5 |
| She a real darling. | +5 |
| He is the love of my life. | +5 |
| Ignoring me won't help. | −5 |
| Sleeping around causes a divorce. | −5 |
| She is the only girl for me. | +5 |
| Taking the children to the play is fun. | +5 |
| Dinning out keeps the spark alive. | +5 |
| You came home at 4.OOam. | −5 |
| She spent the night in jail. | −5 |
| He spends all my money. | −5 |
| She spends all the money. | −5 |
| You have to many credit cards. | −5 |
| You quite your job. | −5 |
| You are nothing but a crab. | −5 |
| Big house on the hill paying the bills. | −5 |

-continued

| Marriage Event | Points |
|---|---|
| Be happy. | +5 |
| Help with the kids. | +5 |
| He cooks all the time. | +10 |
| We go to church on every Sunday. Its time to marry. | +10 |
| You can merry with this girl. | +10 |
| You can marry with this man. | +10 |
| Look out for the judge. | −5 |
| You may end up in court. | −5 |
| Debt has wiped out your marriage you can divorce. | −5 |
| The sex was good the marriage was bad. | −5 |
| Today think before you leap. | −5 |
| Money buy comfort only. | +10 |
| Being together is great fun. | +10 |
| Love takes a spill for fun. | +10 |
| Keep the look of love. | +10 |
| Children are a source of great pride. Save this card. You are a Game winner if only two people are left in the game. | +10 |
| Mistress meets wife | −10 |

Examples of Marriage Cards for Senior Citizen

| Marriage Event | Points |
|---|---|
| Grandma nags to much. | −5 |
| Grandma nags to much but is in love. | −6 |
| Grandpa got a great personality and that's all. | +7 |
| Grandma has lots of love. | +15 |
| Grandpa the man! | +10 |
| Grandpa got great mussels but no brains. | −1 |
| Grandma is hot but has no love. | −1 |
| Setting in the swing takes love you may marry. | +15 |
| Grandpa has a limp willie. Save this card. It is a game winner if only two people are left in the game. | −10 |
| Grandma forgot what fun in the hay is. | −5 |
| Grandma a little senile. | −5 |
| Having fun at 95 makes life worth living. | +5 |
| Take time to smell the roses. | +8 |
| Good loving starts at sun-up. | +10 |
| Grandma lost interest yesterday. | −5 |
| Hot body grandma a winner. | +5 |
| Divorce kills everything, careful what you chose. | −15 |
| Grandpa is a wimp. | −2 |
| Grandpa never does dishes. | −2 |
| Grandma starts things but never finishes. | −2 |
| Know how to finish before you start. | −2 |
| Grandma hard of hearing. | −1 |
| Grandpa hard of hearing. | −1 |
| Grandma does not pay attention when grandpa speaks. | −5 |
| Grandpa does not pay attention when grandma speaks. | −5 |
| Grandpa eyes wonder without glasses. | −5 |
| Grandma eyes wonder with glasses. | −5 |
| Life was good, I made it to a wheel chair. | +5 |
| Grandpa can't go on a date he has no license. | −5 |
| Grandma in bed by 8 pin. | +13 |
| The joint rocks grandma and grandpa still in love. | +10 |
| Adultery causes a divorce. | −10 |
| Abuse causes divorce. | −5 |
| Grandchildren are the pride of life. | +6 |
| Going places without wife. | −2 |
| One way grandpa. | −2 |
| One way grandma. | −2 |
| Create good things. | +12 |
| Lies causes divorces | −2 |
| I'm incompatible. | −5 |
| Don't ignore me. | −5 |

Examples of Divorce Cards for Infant-Preteen

| Divorce Event | Points |
|---|---|
| New Baby on the way. | +2 |
| Take the kids for a stroll. | −2 |
| It's your turn to change his diaper. | −2 |
| Careful with the hose you might get wet. | +2 |
| Girls night out. | +5 |
| Boys night out. | +5 |
| It's time to feed the baby. | −2 |
| Sam. Wake-up feed time. | −2 |
| Walk the baby to stop crying. | −2 |
| Read to the kids 3 books a day. | −2 |
| Take the kids to the park. | −2 |
| Go ice skating. | −2 |
| Go fishing with kids. | −2 |
| It is time to go sailing. | −2 |
| The wife has PPD time for a divorce | +5 |
| No help from husband time for a divorce. | +5 |
| She is a handy person in all things. | −5 |
| No house cleaning for me. | +2 |
| Its time to mow the lawn. | −2 |
| You have to cook tonight. | −2 |
| Night out on the town. | +5 |
| Children demand all your attention. | −2 |
| No time for me - HELP. | −2 |
| Bring me the baby and then cook. | −2 |
| Who said raising kids was work. | −2 |
| Honey put the kids to bed for me. | −2 |
| Clean house tonight I have to work Saturday. | +4 |
| If only I could get a break. | +4 |
| I'm home free summer vacation. | −2 |
| I worked all day, baby not fed, you sleep on couch, house is dirty. | +5 |
| Lack of understanding creates anger makeup. | +2 |
| First car lets go for a ride. | −2 |
| Big diamonds buy the wrong kind of love. | +2 |
| To friends forever. | −5 |
| Today's our first date. | −4 |
| I waited a long time for a kiss. | −2 |
| Let's go to church. | −5 |
| You're grounded. | +5 |
| Last chance to get it right. | +5 |
| I'm glad to be home. | −4 |
| Twenty days of parting straight is too much for me. Want a divorce. This is the game winning card if only two people are left in the game. | +5 |

Examples of Divorce Cards for Preteen-Young Adult

| Divorce Event | Points |
|---|---|
| You get braces. | −7 |
| Be little people. | +2 |
| Swears at partner. | +5 |
| Tells lies constantly. | +5 |
| Gives dirty looks. | +5 |
| We need to talk. | −7 |
| Kicks dog when mad. | +2 |
| Smells like a skunk. | +2 |
| Throws dishes at partner. | +2 |
| Takes keys to the car. | +2 |
| You are more attracted to the lifeguard. | +2 |
| Two straps on shoulder are used for what? | +5 |
| Won't dance with me. | +2 |
| Drinks to much. | +2 |
| Does drugs partner does not know. | +2 |
| Party's every day. | +2 |
| No respect for partner. | +2 |
| Loves to play spin the bottle. | −7 |
| Partner makes your day. | −5 |
| Partners to lame to marry. Save this card. You can win the game with this card if only two people are left in the game. | +5 |
| You throw up on date. | +2 |

-continued

| Divorce Event | Points |
|---|---|
| Totally selfish person. | +2 |
| I'm so hot I can't marry. | +2 |
| I'm an adult that doesn't need a job. | +4 |
| First kiss. | −7 |
| Goes to mall with friends. | −7 |
| Promotes self esteem. | −2 |
| Jealous partner. | +2 |
| Never lies to partner. | −2 |
| Gives partner complete attention. | −4 |
| Helps with dishes. | −7 |
| Your best friend likes same girl. | +2 |
| Sex is every thing. | +5 |
| Does not do drugs. | −2 |
| Has a great since of humor. | −5 |
| Does not abuse relationship. | −4 |
| Skinny dipping for first time. | +5 |
| You sneak over to his or her house. | +2 |
| You broke window by accident throwing rock. | −7 |

Examples of Divorce Cards for Adult-Middle Age

| Divorce Event | Points |
|---|---|
| Never talks to wife and kids. Save this card. It is the game winner if only two people are in the game. | +10 |
| Always takes wife out to supper | −5 |
| Has sugar daddy on the side. | +5 |
| Has sugar momma on the side. | +5 |
| Every thing is your way. | +5 |
| Gossip got the best of her. | +5 |
| Discontent follows him every where. | +5 |
| He is physically abusive. | +5 |
| She is mentally abusive. | +5 |
| You areas crazy as a bed bug. | +5 |
| She a real darling. | −5 |
| He is the love of my life. | −5 |
| Ignoring me won't help. | +5 |
| Sleeping around causes a divorce. | +5 |
| She is the only girl for me. | −5 |
| Taking the children to the play is fun. | −5 |
| Dinning out keeps the spark alive. | −5 |
| You came home at 4.OOam. | +5 |
| She spent the night in jail. | +5 |
| He spends all my money. | +5 |
| She spends all the money. | +5 |
| You have to many credit cards. | +5 |
| You quite your job. | +5 |
| You nothing but a crab. | +5 |
| Big house on the hill paying the bills. | +5 |
| Be happy | −5 |
| Help with the kids. | −5 |
| He cooks all the time. | −10 |
| We go to church on every Sunday. Its time to marry. | −10 |
| You can merry with this girl. | −10 |
| You can marry with this man. | −10 |
| Go see the judge now. You are divorced. | +5 |
| Beware of the judge. | +5 |
| Debt has wiped out your marriage. | +5 |
| The sex was good the marriage was bad. | +5 |
| Today think before you leap. | +5 |
| Money buy comfort only. | −10 |
| Being together is great fun. | −10 |
| Love takes a spill for fun. | −10 |
| Keep the look of love. | −10 |
| Children are the source of great pride | −10 |
| Mistress meets wife | +10 |

Examples of Divorce Cards for Senior Citizen

| Divorce Event | Points |
|---|---|
| Grandma nags to much. | +5 |
| Grandma nags to much but is in love. | +6 |
| Grandpa got a great personality and that's all. | −7 |
| Grandma has lots of love. | −15 |
| Grandpa the man! | −10 |
| Grandpa got great mussels but no brains. | +1 |
| Grandma is hot but has no love. | +1 |
| Setting in the swing takes love you may marry. | −15 |
| Grandpa has a limp willie. | +10 |
| Grandma forgot what fun in the bay is. | +5 |
| Grandma a little senile. | +5 |
| Having fun at 95 makes life worth living. Save this card. You are the game winner if only two people are in the game. | −10 |
| Take time to smell the roses. | −10 |
| Good loving starts at sun-up. | −10 |
| Grandma lost interest yesterday. | +5 |
| Hot body grandma a winner. | +5 |
| Divorce kills everything, careful what you chose. | +15 |
| Grandpa is a wimp. | +2 |
| Grandpa never does dishes. | +2 |
| Grandma starts things but never finishes. | +2 |
| Know how to finish before you start. | −7 |
| Grandma hard of hearing. | +1 |
| Grandpa hard. | +1 |
| Grandma does not pay attention when grandpa speaks. | +5 |
| Grandpa does not pay attention when grandma speaks. | +5 |
| Grandpa eyes wonder without glasses. | +5 |
| Grandma eyes wonder with glasses. | +5 |
| Life was good, I made it to a wheel chair. | −10 |
| Grandpa can't go on a date he has no license. | +5 |
| Grandma in bed by 8 pin. | −8 |
| The joint rocks grandma and grandpa still in love. | −10 |
| Adultery causes a divorce | +10 |
| Abuse causes divorce. | +5 |
| Grandchildren are the pride of life. | −10 |
| Going places without wife. | +2 |
| One way grandpa. | +2 |
| One way grandma. | +2 |
| Create good things. | −12 |
| Lies causes divorces | +2 |
| I'm incompatible. | +5 |
| Don't ignore me | +5 |

Now turning to the judge cards 70, it is appreciated by those skilled in the art that these cards can vary. However, these cards each include what is termed a "judge event". A "judge event" means a message on a card that relates to an instruction or order by a judicial judge to a player of a game.

Example of Judge Events on Judge Cards

The judge is going to save you from your own self. Go see the pastor for counseling. Turn over the pastors top card and follow the pastors instructions.

It was your choice to see another. Go see what the pastor has to say. Pick his card. You are getting another chance to fly right. Now you must follow the pastors instructions, pick his top card.

You may argue with your spouse but not the judge. Stay in judges chamber for three rolls of the dice.

Arguing with your spouse is no fun. Think about what you did wrong. Stay in judges chamber for two rolls of the dice.

Going to the bar will get you in trouble if you want to marry. Rehabilitation is called for in your case. Go to counseling for one month or one roll of the dice. Next roll you are out.

Never argue with the wife. She is half right and the other half is never wrong (the man). This is a free pass. Continue with game.

You stole my life. This act cost me all my dreams. You are out of the game.

Pulling together always works if the rope is not around a tree. Which end are you on? Try marriage again. Continue with game on your next roll.

Pay your child support unless you want to marry. Go see what the pastor has to say. Pick a pastors card (now) and follow his directions.

Speeding through life will cost you dearly. You may not marry unless you slow down. You are in court three days or three rolls of the dice. You are out on the fourth roll.

Doing drugs will cost you your life, your marriage, your money, your home, and all your dreams. You are out of the game.

Watching sports on TV is more important than feeding the baby. You are in counseling for three rolls of the dice. On the fourth role you're out of the judges chamber counseling sessions.

There is help for PMS. Do what the judge says and no excuses. Go see the doctor for two rolls of the dice. On the third roll you are out of the doctor's care and out of the judge's chamber. SEE YA.

You rolled the dice in flirting with him in front of your boyfriend and now you have neither. You loose all your points. Place your icon on start and start over. Wait your turn.

Nobody can help you but yourself. Therefore you must start over and try again. You lose all your points on your score card. Place your icon on start and try again. Wait your turn.

It was your choice to commit adultery. You are out of the game.

If you want to be a winner be careful of your choices. Other people can make them for you and they may not be fun. This is a free pass for the judge. You may leave court on your next turn.

Being old and wise does not mean you are always right. When you have to seethe judge. You loose a turn at rolling the dice. The second role you are out of here.

Love has no bounds. Even the judge knows this. The judge awards you (add) 10 points to your score card and toward a happy life. You may leave court on the next roll of the dice.

I need help breaking my bad habits. What must I do? The judge says deduct 5 points from your score card and you lose 2 turns at rolling the dice. On the third roll you may leave the judge's square and don't pick up any more bad habits.

Quiet time is good for everyone. Keep it shut and you may leave your next turn.

Arbitration is wonderful. If you have 4 points or more add another 46 points to your score card. This will give you a total of 50 points or more on your score card and the winner of the game. If you do not have 50 points put this card at the bottom of the judges stack and continue with the game. SORRY! ! ! ! !

You have self-esteem issues and the judge knows it. You are ordered to attend church and get help from the pastor. After two rolls of the dice you are out of the judges square.

Birds of a feather stick together and are very close. What color are your feathers? Jail birds like the color of orange. The judge says pick another card off his stack and follow the directions this time.

Children are the most important thing in life. Did you cast them off? If the judge says yes, you are out of the game. The judge says no. Your next roll you are out.

Lets go dancing and be happy. Make constructive things happen in a marriage. The judge says do something for her. She has done a lot for you. You can now continue with your plan. Add 10 points to your score. Next roll of the dice you are out of judge's chamber.

The burden of being old and feeble is sometimes a ball and chain. The judge says take it to the pastor for review. Go now to pastor and see what he says. Pick the top card in the pastor's stack and follow its directions.

Your children are what you are as a parent. Careful unspoken words decide the out come. Second roll of the dice you are out of the judges chamber.

Teenage boot camp is where you need to be according to your parenting skills. You lose 10 points for being a sloppy parent. On the second roll of the dice you are out of the judge's chamber.

Crack will crack you up. You lose all your points. Next roll you are out of judge's chamber.

Careful where you get your shots at the doctors office or at the bar. The judge says stay in his chamber for two rolls of the dice on the third roll you are out.

A good cop does not care how good looking you are. Neither does a good judge. DUI sentence to stay in the judges chamber for three rolls of the dice. Next roll you are out.

I'm so good I shouldn't be here. That's right. Go see the pastor and find out if you are good. Follow the pastors directions.

You like being a leader. Then learn how. You are out on the next roll.

If you want to play, you have to pay. Twenty five points to the judge for child support. Go earn some points, you are out on your next roll.

Stealing is not good pay the judge says deduct −10 points and get a job. Continue play next roll you are out of judge's chamber.

Add 5 points to score card for getting hit by a car while riding bicycle. Have a speedy recovery. Next roll of the dice you are out of the judges chamber.

Keep your dreams alive and time will full fill them all. Next roll of the dice you are out of the judges chamber.

Payment in dreams cost the most in life. Always drive responsibly you own that car. Subtract ten points from your score card.

There is also provided the pastor cards 80. The pastor cards can vary and include various pastor events. As used herein, the term pastor event means an instruction, order or advice from a pastor or preacher to a player of a game.

Example of Pastor Events on Pastor Cards

You have to think twice about life if you draw this card. You just got caught stealing a bike, now it's pay back. Sit in the pastor's square for three rolls of the dice. On the third roll you are out of the pastors square. Continue with the game.

You should love your wife or husband with all your heart and soul. Plan for a wedding, the next roll you are out of the pastors square.

No commitment in life is no commitment to the game. You are out of the game.

Callous words can hurt a lot. Make amends while you can says the pastor. Skip two turns and you are out of the pastor's square on your third roll.

Be happy, a great sense of humor goes a long way. You get fifteen points toward your goal. Continue on with the next roll of the dice.

Self discipline is the hardest lesson in life to learn. The pastor says stay on the pastor square and you may leave on the third roll of the dice.

Today I brought cookies for everyone. Doing good always pays. Add 10 points toward your goal. Love the pastor and you are out of here on your next roll.

Loving to share with one who cares is what life's all about. You "WIN THIS GAME".

"Only you can change your heart", the pastor says. You get five points. It's a start. Good luck! Next roll you are out.

Adultery in life only pays if you want a divorce. The pastor says get counseling from the judge. Move your icon to the judge's square and draw a card from his stack and follow his directions.

"The scales of justice are often unbalanced in your heart", says the pastor. Donate 5 (deduct) points to the pastors coffers if you have them. The next roll you are out of the pastors square.

You can buy and sell that which is good. To give freely is the best way. Deduct ten points and give it to the pastor's coffers. Your next roll of the dice you are out of pastor's square.

On life's highway there are winners and losers. By seeing the pastor you are the winner of this game if only two players are left in the game. Congratulations! ! ! If not put the card on the bottom of the pastor's stack of cards and continue with the game. Next roll you are out of the pastor's square.

The pastor says party on and you will never marry. Give 5 points to the homeless and deduct them off your score card. The second roll of the dice you are out of the pastor's square and on with the game.

The pastor has counseled you for three months. If only two players remain in the game you are the winner. If more than two players are in the game place this card on the bottom of the pile and continue play. You are out of the pastor's square on the next roll of the dice.

Success on Wall Street does not transcend to a successful marriage. Continue rolling the dice when its your turn. On the third roll of the dice you are out of the pastor's square.

Family and children are everything. Love one another, you can add fifteen points to your score card. The next roll of the dice you are out of the pastor's square.

Who's system of values do you represent. Ten points for a divorce (add 10 points to your score card) and no points for marriage. You choose marriage or divorce says the pastor. On the next roll of the dice you are out of the pastors square.

Arguing is never good, you lose. Stay in counseling for three turns. On the third role of the dice you are out of the pastors square.

Arguing with the pastor can put you out of the game. You must deduct 5 points and must stay in the pastor's square. On the third roll of the dice you are out.

Never argue with the wife. She is always half right and the other half is never wrong (the man). Good luck! You are out of here on the next roll.

The me attitude is an illusion. Soon it will fade away, when it is only me left in the world. Counsel with the pastor on the third roll. You are out of the pastors square.

Life in the fast lane is like a tire hitting a tack. Life can go flat in a hurry. On the first roll you are out of the pastor's square.

Selfish aspirations are good for one thing and that is a divorce. You loose ten points off of your score card. You are out of the pastor's square on the next roll.

When watching sports, bring the wife and children. They will have fun too. Including others says a lot. You are out of the pastor's square on the next roll of the dice.

You rolled the dice in flirting with your wife's best friend. You lose all your points. Take your icon and place it on start. You must start over on the next roll of the dice.

Have you learned the good and bad in life? Be careful to do good for others. You are out of the pastor's square on the next roll of the dice.

Being a teenager and acting like a teenager are two different things. You must stay in the pastor's square for two rolls of dice. On the third roll you are out.

Ruling out "one first" in life is the best thing you can do. Being equal you are ready to marry. Good luck! You can add 20 points to your score card toward your goal and you are out of the pastor's square on the next roll of the dice.

A death in the family can be devastating. It can also bring families closer together by loving one another. You get ten points toward your goal and out of the pastors square on the next roll of the dice.

Taking your parents car without their permission is a big NO NO. Learn self discipline and continue play. Donate 5 (deduct 5 points off your score card) points to the pastors coffers. Your next roll of the dice you are out of the pastor's square.

Trouble at home means trouble everywhere. Counseling will help a lot. Stay in the pastor's square for two rolls of the dice. On the third roll you are out.

I lost my job and don't know what to do. What will counseling do for me. One roll of the dice and you are out of the pastor's square.

You want a divorce after adopting three children. What is going on? Stay in counseling for three rolls of the dice. On the fourth roll you are out.

Why would you sell your home, buy a boat, and sail around the world? I live by myself. Have fun. Add ten points to your score card. The next roll of the dice you are out of the pastor's square.

Being a chronic liar is not good for anyone and worst of all for you. You must take your icon. Place it on start and start over. You loose all your points that you have accumulated so far. Start over on your next roll of the dice.

Getting mad and punching a hole in the wall is not always the best thing to do. Stay in counseling and the third roll of the dice you are out of the pastors square.

Anniversary celebrations are always fun. Make the most of life. Add ten points on your score card toward your goal. Next roll of the dice you are out of the pastor's square.

Everyone has a good purpose. What is yours? Have a happy game. Add ten points on your score card towards your goals. Next roll of the dice you are out of the pastor's square.

To marry and be happy you cannot continue to commit adultery. Sorry you are out of the game.

In addition to the game board discussed above, provided with the game and game apparatus of the present invention is a series of player tokens 90. The tokens can vary but some examples of appropriate tokens are: Man, Woman, Couple, Cross, Preacher, Judge, Baby, Candle, Wineglass, Car, Wagon, Boat, Bicycle, Horse, etc. Furthermore, the game apparatus is provided with dice 92. The term "dice" as used herein includes a single die. Because the game disclosed herein is based on the accumulation of points, a score sheet 94 is provided. This can be provided in tablet form with a series of score sheets that can easily be torn from the tablet and distributed to players of the game.

Prior to playing the game, the marriage cards 50 and divorce cards 60 are placed on the game board 10. As discussed above, the marriage cards 50 and the divorce cards 60 are divided into four sets with each set being placed in a particular quadrant of the game board. It is noted that each set of marriage cards 50 and each set of divorce cards 60 are particularly designed for one of the quadrants 30, 32, 34 or 36 of the game board 10. As noted above, the individual sets of the marriage and divorce cards 50, 60 are color coated. In addition, the game board 10 and parts thereof are also color coated. In particular, an individual quadrant of the game board can be color coded to match an individual set of color coated marriage and divorce cards 50, 60. Care may be taken to ensure that the right set of cards are placed in the right quadrant of the game board 10.

All players will select their icons or tokens 90 and place them in the start space 12 to begin the game. Note the tokens 90 will move in the direction of the arrow (not shown) from start space 12, generally clockwise as viewed in FIG. 1. Each player rolls the dice 92 to determine the order of play. The player with the highest number begins. The other players follow clockwise around the board. If there is a tie for the highest number, the players will roll the dice 92 until the tie is broken.

Before beginning the game, each player must declare his goal for the game, that is, whether the player's goal is to be married or divorced. Each player must draw two cards. If the player's goal is to marry, then the player must select two cards from any one of the marriage card sets 50. When selecting cards, the player will also draw the top card of the selected stack. If the player's goal is to be divorced, the player will select two cards from any of the four sets of divorce cards. These two cards will constitute each player's two cards for starting the game. A player may not hold both a marriage card 50 and divorce card 60 in his hand at anytime during play. Except for the basic identity of the cards held, that is, whether the card is a marriage card 50 or a divorce card 60, the content and points associated with the cards are maintained confidential. Each player is given a score card and the numeric value of the two cards must be added at the start of the game and entered on each player's score card. A running total of points is maintained at all times throughout the course of the game.

Each player places an icon or token 90 on the start space 12. The first player rolls the dice and moves the icon or token 90 clockwise and in the direction indicated by the arrow adjacent start space 12. The player moves the icon or token the number of spaces indicated on the dice 92. Succeeding players will follow. Should a player land on a space that includes points, then the points are added or subtracted to his score card. Play continues with the next player taking a turn. When a player lands on space 14, which is marriage or divorce space, the player must always take the top card from the marriage or divorce stack of cards disposed in the quadrant of the game board 10 where the player's icon or token lands. When a player lands on the marriage or divorce space 14, the player may choose from the following three options. First, the player must take the top card from the marriage or divorce set of cards in the quadrant where the player's token or icon lies. After taking the top card, the player adds or subtracts the points shown on the card to the player's score card and returns the card to the bottom of the stack. A second option enables the player to take the top card from the set of marriage or divorce cards in the quadrant where the icon lies. The player adds or subtracts the points on the player's score card and selects another card from the player's hand to discard. The discarded card is returned to the bottom of the stack in the quadrant from which it was taken. A third option exists when a player is holding a "winning card." If a player holding a winning card draws a second winning card, the second winning card must be returned to the stack from which it was drawn and if there are points associated with the card, the points are added to the score card of the player. A player can hold only one card at a time that states that the player is a winner.

There are occasions when a player will land on a judge space 16 or a pastor space 18. The same rules apply for the judge space 16 and the pastor space 18. If a player lands on the judge space 16, the player is required to take the top card from the judge cards disposed on the game board. Once the player complies with a judge card 70 or a pastor card 80, the card is returned and placed on the bottom of the appropriate stack. In some cases, the judge and pastor card will direct a player to the judge's or pastor's chambers on the game board 10. During play, should a player in the pastor's or judge's chamber roll a double, then the player gets out of the pastor's or judge's chambers on that roll of the dice and moves the player's token 90 the number of spaces shown on the dice.

In the embodiment illustrated herein, the game board includes one or more spaces that command "Go to Pastor's Chamber" or "Go to Judge's Chamber." In this case, the player takes the icon or token 90 and places it in the pastor's or judge's chambers. A player is not permitted to pass start space 12 and to collect the conventional ten points awarded players for passing the start space. Furthermore, when a player lands in the space "Go to Pastor's Chamber" or "Go to Judge's Chamber," the player is required to draw from the judge cards 70 or pastor cards 80. In either case, the player is required to disclose the contents of the card to the other players and to follow the order, instruction, advice or dictates of the card. The card is then returned to the bottom of the appropriate stack.

There are some basic rules in the embodiment illustrated herein for normal play of the game. As stated above, when a player lands in the pastor's or judge's chambers during normal play, and rolls a double, the player is automatically out of the judge's or pastor's chamber. The player moves the token or icon the number of spaces indicated on the dice and play continues. If a player draws a judge or pastor card that states that the player is out of the game, the player is deemed out of the game and is not permitted to roll the dice or participate further in the game until a winner is declared and a new game is commenced. When a player leaves a game, the player's cards are returned to the appropriate set of cards on the game board and always the discarded cards are placed at the bottom of a stack. A player that is required to go to the pastor's or judge's chambers will be required to resume play from the pastor's or judge's chamber, not from a prior position on the game board. Cards drawn from any of the stacks on the game board should be carefully read. It is to be noted that some of the points awarded in the course of the game are negative points and hence, a player's score card can at any time indicate that the total number of points possessed by the player is negative. A player having a negative score can nevertheless continue play so long as the player is not ruled out of the game by the game cards or other rules.

As noted above, each time a player passes the start space 12, the player will be awarded a certain number of points which in the case of the game illustrated herein, is ten points. At the start of the game when the players begin from the start space 12, there are no points awarded for moving past the start space. The points accumulate as a result of passing the start space 12 and should be added to the player's score card during his turn. If the points are not awarded during the player's turn, then the points are lost and cannot be added at a later time.

There are a number of ways to win the game. Certain rules can establish various winning strategies or scenarios. However, in the case of the game discussed herein and the example given, there are four ways to prevail in this game. First, when only two players remain in the game and both players hold a marriage card 50 or a divorce card 60 that indicates that the holder of the card is a winner, the first player who announces first that he or she holds a winning card is deemed the winner. Secondly, a player can win by being declared so by a judge card 70 or a pastor card 80. Furthermore, a player may win if he or she is the first to accumulate a certain number of points in the game, for example, 50 points. Finally, a player can win by default if only two players are left in the game and a card declares the other player out of the game. Should for any reason two winners arise at the same time, a roll of the dice will determine the winner. In this embodiment of the game, the player with a low roll is declared the winner.

From the foregoing specification and discussion, it is appreciated that the present invention presents an interesting and fun game that revolves around marriage and divorce and the many and varied events that occur in the course of life that can impact plans to be married or plans to be divorced.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A marriage and divorce game wherein in the course of playing the game, players are exposed to events and consequences that impact or relate to marriage and divorce, the game comprising:

a series of game tokens wherein each token is assigned to one player for use during the course of playing the game;

dice;

a game board;

a series of defined spaces disposed about the periphery of the board wherein during the course of the game, players roll the dice and based on a number rolled, the player advances the player's token a like number of spaces along the board;

the game board being divided into a series of at least four quadrants;

a series of marriage cards with each marriage card including a marriage event and a corresponding number of points wherein the points of the marriage cards include both plus points and negative points;

a series of divorce cards with each divorce card including a divorce event and a corresponding number of points wherein the points of the series of divorce cards include both plus points and negative points;

wherein the marriage cards are divided into at least four sets;

wherein the divorce cards are divided into at least four sets;

each quadrant of the game board including a marriage card area specifically inscribed to receive one set of the marriage cards;

each quadrant of the game board including a divorce card area specifically inscribed to receive one set of the divorce cards;

the series of defined spaces including a series of "Marriage" and/or "Divorce" spaces and wherein when a player's token lands on either a "Marriage" or "Divorce" space, the player is required to draw either a marriage card or a divorce card from the set of marriage or divorce cards disposed in the closest quadrant to the "Marriage" or "Divorce" space occupied by the player's token;

a series of pastor cards with each pastor card including a pastor event;

a series of judge cards with each judge card including a judge event;

the game board including a pastor card area inscribed to receive the pastor cards;

the game board further including a judge card area inscribed to receive the judge cards;

the series of defined spaces including a series of "Pastor" and "Judge" spaces and wherein when a player's token lands on either a "Pastor" or "Judge" space, the player is required to draw either a Pastor card or a Judge card from the series of pastor or judge cards disposed on the game board;

a church disposed on the game board; and a courthouse disposed on the game board.

2. The game of claim 1 wherein the church includes a church structure extending upwardly from the game board, the church structure including a popup church wherein the popup church is moveable between a generally flat configuration where the popup church lies in a generally flat configuration adjacent the game board to a popup configuration where the popup church assumes a three-dimensional structure on the game board; wherein the courthouse includes a courthouse structure extending upwardly from the game board, the courthouse structure including a popup courthouse wherein the popup courthouse is moveable between a generally flat configuration where the popup courthouse lies in a generally flat configuration adjacent the game board to a popup configuration where the popup courthouse assumes a three-dimensional structure on the game board.

3. The game of claim 1 wherein the church includes a church structure extending upwardly from the game board and wherein the courthouse includes a courthouse structure extending upwardly from the game board.

4. The game of claim 3 wherein the church structure and the courthouse structure are generally centrally located on the game board.

5. The game of claim 1 wherein at least some of the defined spaces include points such that when a player's token lands on a defined space including points, the player is awarded the number of points associated with the space.

6. The game of claim 1 including a judge's chambers area on the game board and extending from an outer periphery area of the board inwardly toward the courthouse; the game further including a pastor's chamber area extending from an outer periphery area of the board inwardly toward the church.

* * * * *